US005141769A

United States Patent [19]

Platz

[11] Patent Number: 5,141,769

[45] Date of Patent: Aug. 25, 1992

[54] METHOD FOR APPLYING WEAR-RESISTANT DISPERSION COATINGS

[75] Inventor: Albin Platz, Ried-Baindlkirch, Fed. Rep. of Germany

[73] Assignee: MTU Motoren-Und Turbinen-Union GmbH, Munich, Fed. Rep. of Germany

[21] Appl. No.: 628,215

[22] Filed: Dec. 17, 1990

[30] Foreign Application Priority Data

Dec. 19, 1989 [DE] Fed. Rep. of Germany ..... 3941853

[51] Int. Cl.[5] ..... B05D 1/08; B05D 1/02; B05D 1/36; B05D 1/34

[52] U.S. Cl. ..... 427/34; 427/196; 427/203; 427/205; 427/425; 427/426

[58] Field of Search ..... 427/34, 196, 202, 203, 427/204, 205, 425, 421, 422, 423, 424, 426

[56] References Cited

U.S. PATENT DOCUMENTS

| | | | |
|---|---|---|---|
| 3,020,182 | 2/1962 | Daniels | 427/423 |
| 3,340,084 | 9/1967 | Eisenlohr | 427/423 |
| 3,844,729 | 10/1974 | Sedlatschek et al. | 427/225 |
| 4,160,048 | 7/1979 | Jaeger | 427/425 |
| 4,224,356 | 9/1980 | Singer | 427/423 |
| 4,241,110 | 12/1980 | Ueda et al. | 427/203 |
| 4,358,471 | 11/1982 | Derkacs et al. | 427/34 |
| 4,386,112 | 5/1983 | Eaton et al. | 427/423 |
| 4,596,718 | 6/1986 | Gruner | 427/425 |
| 4,740,395 | 4/1988 | Tsunekawa et al. | 427/423 |
| 5,022,455 | 6/1991 | Takeda et al. | 427/196 |

FOREIGN PATENT DOCUMENTS

| | | | |
|---|---|---|---|
| 2823817 | 12/1978 | Fed. Rep. of Germany | 427/142 |

*Primary Examiner*—Marianne Padgett
*Attorney, Agent, or Firm*—W. G. Fasse

[57] ABSTRACT

Surfaces of structural components of metal or the like are protected by depositing a wear-resistant dispersion coating of a matrix metal and hard-material particles embedded in the metal matrix. The depositing is accomplished by a sequential plasma spraying and particle blasting, whereby the hard-material particles are applied separately from the plasma stream to inject the particles into the plastically still deformable matrix metal. The coating steps are performed in an evacuated chamber or in an inert gas environment. These coatings are especially suitable on the blade tips of gas turbine engines, on the sealing fins of labyrinth seals or as "rub" coatings on circumferential rotor surfaces or the like.

7 Claims, 1 Drawing Sheet

METHOD FOR APPLYING WEAR-RESISTANT DISPERSION COATINGS

FIELD OF THE INVENTION

The invention relates to a method for depositing or applying wear-resistant dispersion coatings including hard-material particles embedded in a matrix metal on metallic components. The coatings are applied by plasma spraying and blasting techniques.

BACKGROUND INFORMATION

Two different processes are known for depositing hard-material particles together with the matrix material, on component areas to be protected. In a first known process the hard-material particles are loaded into a plasma torch together with the matrix metal and are sprayed onto the component in the plasma beam or stream. The first process has the disadvantage that in the hot plasma stream, sharp edges of the hard-material particles may be lost because particle points, edges and burrs become plasticized or blunted by fusion with other particles. Another disadvantage of the first known method is caused by the difficulty to properly meter and uniformly distribute the hard-material particles. A high input or dose of hard-metal particles, e.g., causes the particles to collide on the component surface with one another, so that the particles bounce back into the plasma stream and form matrix holes on their underside when reimpinging on the component surface. As a result the anchorage of the particles in the matrix is minimal and it takes little wear to make them work loose from the matrix metal. The particles may also agglomerate in the matrix metal, whereby their uniform distribution throughout the matrix material is not assured.

In order to prevent the hard-material particles becoming blunt along particle edges by fusion, the second known coating technique resorts to sprinkling the hard-material particles under the action of gravity onto the surface in the area where the plasma stream applies the matrix material to the component surface. The second known technique has the disadvantage that the hard-material particles sprinkled onto or into the coating area fall on an already solidified matrix metal surface and are covered with matrix metal by the plasma stream, so that the hard-material particles will not be anchored in the matrix metal at the particle underside. Worse yet, pores may partially form on the particle underside. Such hard-material particles which are loose at their underside, may, under centrifugal load on the coating, cause a partial or complete detachment of the dispersion coating, especially in areas where hard-material particles sprinkled onto or into the coating area have agglomerated. Additionally, the hard-material particles may prematurely detach from the metal matrix, because their underside is not sufficiently anchored to the matrix metal.

OBJECTS OF THE INVENTION

In view of the above it is the aim of the invention to achieve the following objects singly or in combination:

to provide a method which prevents the formation of pores when the hard-material particles are introduced into the matrix metal;

to improve the anchoring of the hard-material particles in the matrix material;

to incorporate the hard-material particles into the metal matrix without causing particles to accumulate or agglomerate to assure a uniform distribution of the particles in the matrix material;

to avoid the formation of pores in the matrix material; and to provide a method for the formation of the above defined coatings, whereby the sequential application of matrix layers and embedding of hard particles in such layers can be performed rapidly by moving the surface to be coated sequentially past layer forming and embedding stations.

SUMMARY OF THE INVENTION

According to the invention the matrix metal is deposited by successively plasma spraying several thin layers of matrix material having a thickness half to double the mean grain diameters of the hard-material particles, by blasting or blowing the hard-material particles separately into the plastically still readily deformable matrix metal of each layer, and by spraying a final layer of matrix metal to form a top cover layer. Thus, plasma spraying and blasting steps alternate with each other without mixing a plasma stream with a blasting jet and a plasma spraying step is performed first and last.

This method provides an advantage in that hard-material particles retain their sharp edges and are anchored by their underside and along all other sides in the matrix metal, whereby the abrasion resistance of the dispersion coating is improved. The high kinetic energy imparted to the hard-metal particles by a blasting tool injects the hard-material particles into the matrix material, wherein the particles are firmly anchored along their lower surface and on all other surfaces in the matrix metal layer. The hard-material particles are firmly locked and bonded into the matrix metal, because the temperature of the matrix metal layer at the time of impingement is within a range that permits the matrix layer to undergo plastic deformation with a substantial energy input. Since the particle blast impinges when the matrix metal layer is still plastically deformable, the hard-material particles can be introduced and anchored without requiring a great amount of deformation energy. A subsequent final or surface matrix metal layer then completely embeds and covers the hard-metal particles in the matrix metal.

In a preferred embodiment of the present method the blast of hard-material particles impinges in an area of the matrix metal layer from which loose or rebounding hard-material particles can drop downwardly under the action of gravity. This feature simultaneously prevents agglomeration of hard-material particles, because layering of hard-material particles directly over another is avoided. When the matrix metal and hard-material particles are deposited in a synchronized sequence with a short phase shift between plasma spraying and particle blasting, the hard-material particle blast can be made to substantially immediately follow the matrix metal stream at a short distance. The upper limit of this short distance is the required plasticity of the matrix material which is in turn determined by the increasing strength and hardness of the matrix material when the plasma melt is cooling down.

If the matrix metal spraying and hard-material particle blasting cannot be deposited with a phase shift which is short enough to assure the required plasticity of the matrix material, it is still possible to perform the present method by heating the component with a matrix metal layer on it, to temperatures above 450° C. at which the matrix material will be readily plastically deformed. The heating may take place before the hard-material particles are blasted into the matrix or during the blasting.

In a further preferred embodiment of the present invention the component is moved, preferably rotated, to expose the component surface successively to a plasma spraying stream and a hard-material particle blast.

By blasting the hard-particles with a separate blast the insertion of the hard-material particles becomes independent of the plasma stream, and thus better controllable, especially with regard to the hard-material particle rate and uniform distribution, which is an advantage of the invention. The component feed motion enables the hard-material particle blast to impinge on the plasma-sprayed matrix metal with a delay of fractions of a second so that the particles can dig into plastically still readily deformable matrix material. Rotational feed advance of the component provides an advantage in that several layers of matrix metal and hard-material particles can be deposited in rapid succession.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
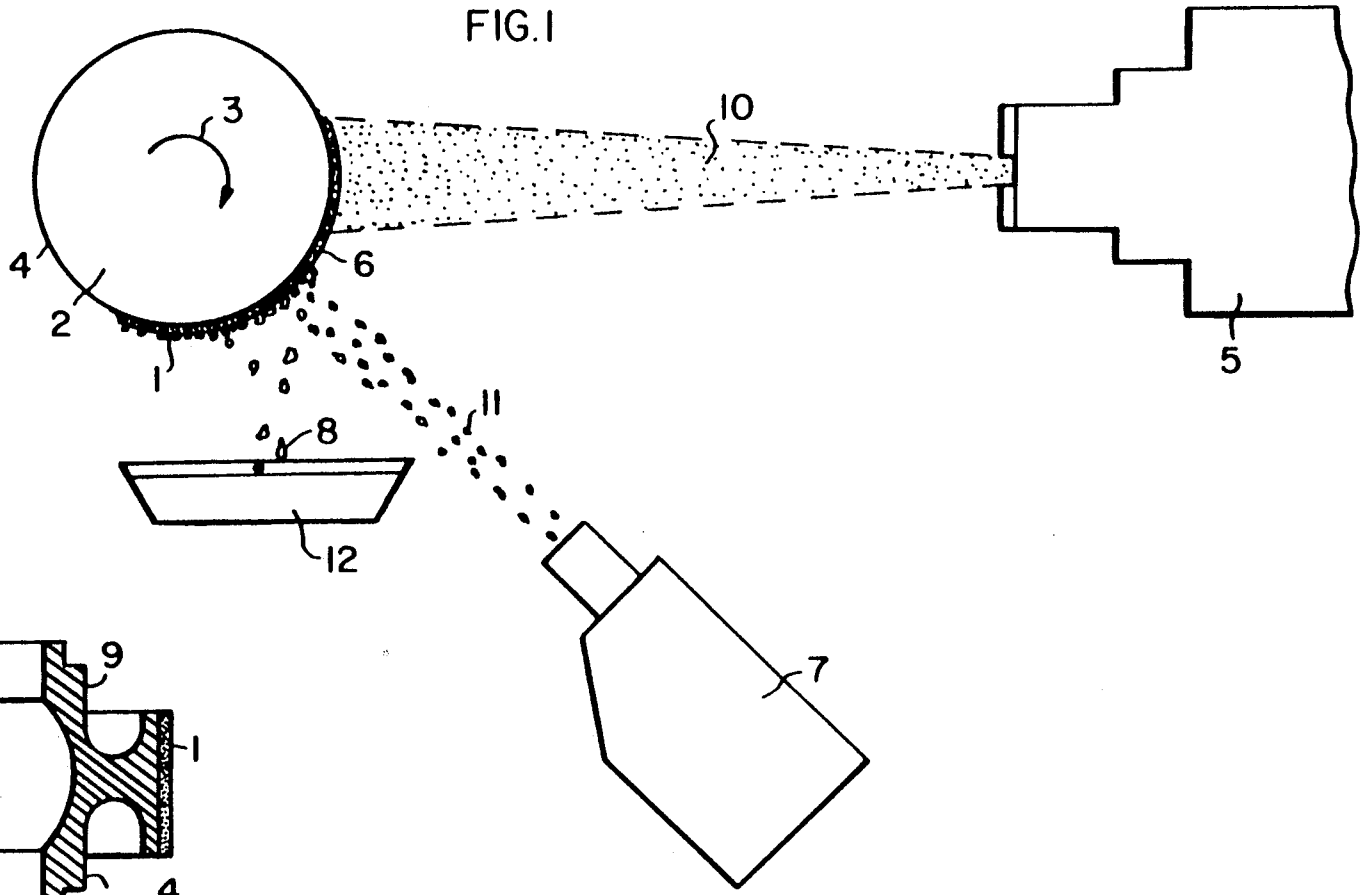
FIG. 1 illustrates an arrangement for depositing layers of matrix material in sequence with blasting hard-part into the matrix material layers to form an abradable coating on a rotor disk.

FIG. 1 shows an arrangement for depositing a dispersion coating 1 on a rotor disk 2. For this purpose, the rotor disk 2 is rotated about its rotational axis in the direction of arrow 3. A plasma stream 10 of Ni/Co matrix metal is sprayed laterally onto the circumferential surface 4 of the rotor disk 2 by means of a plasma torch 5. One-eighth or 45° of a revolution later, hard-material particles are formed as a blasting jet, are introduced or blasted into the still plastically readily deformable matrix metal 6, by means of kinetic energy produced by a hard-metal particle injector 7. Bouncing and dropping hard-metal particles 8 are collected in a pan 2 and returned to the hard-material particle injector 7 for repeated use. This hard-material particle injector 7 may be constructed as a gas-operated blasting gun with means for blowing or blasting hard-metal particles made of, e.g. ceramic powder, where this arrangement is used for performing the coating in an inert gas atmosphere. In evacuated chambers the hard-material particle injector 7 takes the form of, e.g. a centrifugal impeller. As shown in FIG. 1 the plasma stream 10 and the blasting jet 11 are not mixed with each other.

Figure 2:
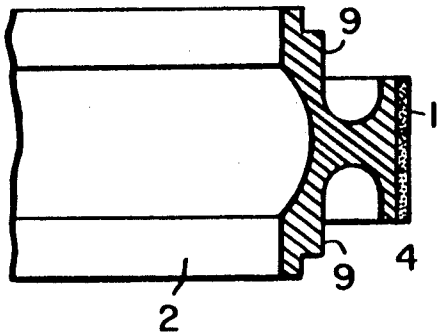
FIG. 2 is a cross-sectional view illustrating the rotor disk with an abradable coating applied as taught herein.

FIG. 2 is a radial cross-sectional view through the rotor disk 2 with a dispersion coating 1. During deposition of the coating 1 the rims 9 are masked, leaving only the circumferential surface 4 to be provided with the wear-resistant dispersion coating.

Although the invention has been described with reference to specific example embodiments, it will be appreciated, that it is intended to cover all modifications and equivalents within the scope of the appended claims.

What I claim is:

1. A method for applying wear resistant dispersion coatings having hard material particles dispersed and anchored in a metal matrix, to a surface of a metallic component, comprising the following steps:

(a) repeatedly plasma spraying a plasma stream to form a matrix metal on said surface, said metal matrix having several sequentially applied thin layers of matrix metal, each of said thin layers having a thickness within the range of one half to twice an average particle size of said hard material particles, (b) repeatedly and separately blasting hard material particles into each of said thin layers of matrix metal while the respective thin layer of matrix metal is still plastically deformable, said blasting directing a blasting jet of hard particles onto said still plastically deformable metal matrix so that mixing of said plasma spray with said blasting jet is avoided and hard material particles not anchored in said metal matrix are rejected by said surface to avoid hard material particles that are insufficiently anchored in said metal matrix, and (c) applying a cover layer of matrix metal by plasma spraying, whereby said blasting steps alternate with said plasma spraying steps and so that said plasma spraying steps are performed first and last, whereby original particle characteristics are retained.

2. The method of claim 1, moving said metallic component past a plasma spraying station and then past a blasting station, so that the surface of said metallic component is sequentially exposed to a plasma spraying beam and to a hard particle blasting beam.

3. The method of claim 2, wherein said moving imparts a rotational movement to said metallic component.

4. The method of claim 1, wherein said plasma spraying and said particle blasting are timed relative to each other, so that said metal of said matrix is still sufficiently plastically deformable when said hard-material particles are blasted into said metal matrix.

5. The method of claim 1, wherein said metallic component is heated to a temperature sufficient to keep an applied matrix metal layer plastically deformable by said hard-material particles blasted into the matrix metal layer.

6. The method of claim 1, wherein said rejected hard material particles are caused to fall down by gravity.

7. The method of claim 6, comprising collecting and returning said rejected hard material particles to an injector for repeated use of said hard material particles.

* * * * *